United States Patent [19]

Kirchhan

[11] 4,055,140

[45] Oct. 25, 1977

[54] JET DRIVE BOAT COVER

[76] Inventor: James J. Kirchhan, 1192 Paularino Ave., Costa Mesa, Calif. 92626

[21] Appl. No.: 649,472

[22] Filed: Jan. 15, 1976

[51] Int. Cl.[2] ..... B63H 5/16

[52] U.S. Cl. ..... 115/76; 49/465; 114/221 R; 114/227; 115/11; 292/111

[58] Field of Search ..... 115/.5 R, .5 HC, 11, 115/71, 75, 76; 114/173, 174, 177, 182, 197, 198, 221 R, 227, 229; 292/65, 66, 110, 111, 113; 49/463, 465; 244/53 B

[56] References Cited

U.S. PATENT DOCUMENTS

| | | | |
|---|---|---|---|
| 3,306,046 | 2/1967 | Trapp | 115/12 R |
| 3,309,115 | 3/1967 | Langer | 292/113 |
| 3,329,121 | 7/1967 | Ulrich et al. | 114/227 |
| 3,540,404 | 11/1970 | Modrey | 114/198 |
| 3,647,251 | 3/1972 | Brown et al. | 292/111 |
| 3,661,410 | 5/1972 | Larson et al. | 292/111 |

FOREIGN PATENT DOCUMENTS

| | | | |
|---|---|---|---|
| 1,363,626 | 5/1964 | France | 49/463 |

*Primary Examiner*—Stephen G. Kunin
*Assistant Examiner*—Charles E. Frankfort
*Attorney, Agent, or Firm*—George F. Bethel; Patience K. Bethel

[57] ABSTRACT

A jet drive boat propulsion unit cover for purposes of covering the fluid intake of a jet powered boat. The cover accommodates itself to the intake opening including the grillwork thereof, in a manner whereby it covers and seals the intake from foreign objects which might contaminate and adversely affect the wear and operation of the jet power unit, such as the impeller, bearing surface, and other wear areas. The cover is secured by means of an overcenter latching linkage having a member that moves eccentrically around an axis to cause a hook to engage the grating or grillwork of the opening so that it can be easily latched and unlatched. The foregoing provides a generally sealed relationship around the edges of the opening to prevent the migration of foreign matter into the jet drive unit.

10 Claims, 11 Drawing Figures

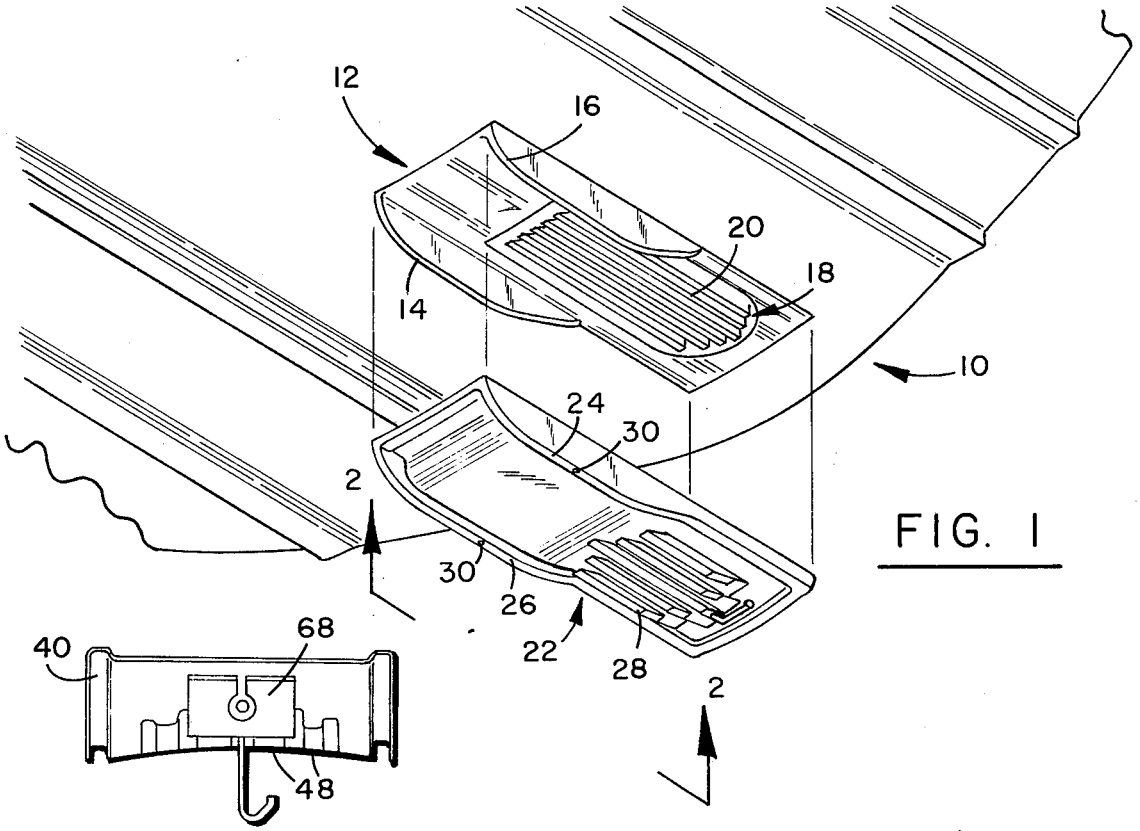
FIG. 1
FIG. 6
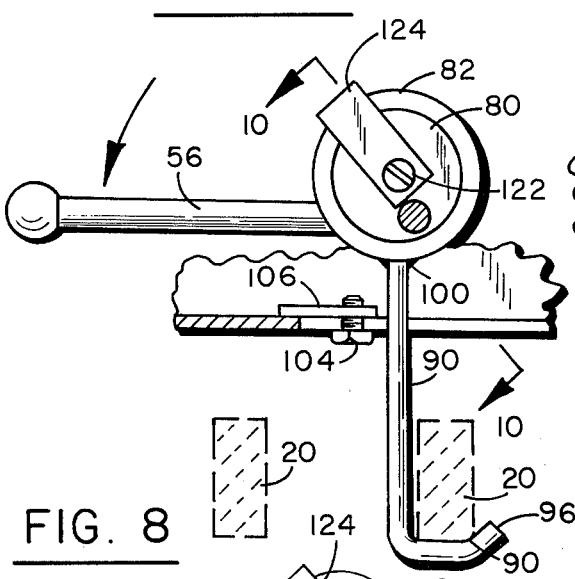
FIG. 8
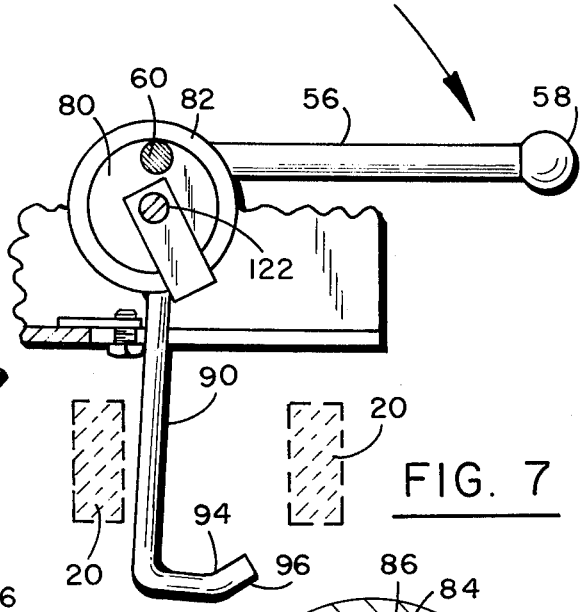
FIG. 7
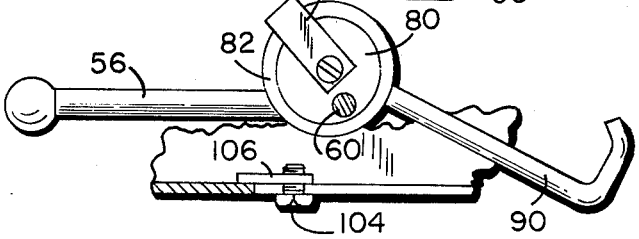
FIG. 11
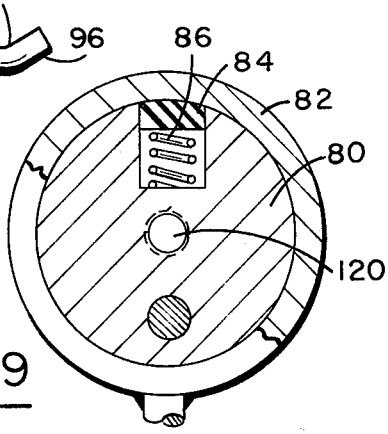
FIG. 9

JET DRIVE BOAT COVER

BACKGROUND OF THE INVENTION

1. Field of the Invention

The field of this invention lies within the jet drive boat art. More specifically, the invention relates to the protection and maintenance of jet drive boats by covering and sealing the input of a jet drive boat from foreign matter.

2. The Prior Art

Jet drive boats powered by a stream of water have become quite popular. The water is usually drawn into an opening in the bottom of the hull and accelerated by an impeller. The accelerated system of water is then forced out through a jet nozzle at a high velocity.

The boat generally operates on the same principle that makes jet aircraft operate. It provides superior response and other characteristics over those of conventional propeller driven craft. Such jet powered boats do not incorporate props, struts, or any other type of substantial protrusion.

Many of the internal working members of the jet drive system are critical in their tolerances and bearing surfaces. The impeller usually spins at a high speed and should not be exposed to substantial foreign matter in its bearing surfaces. The impeller is connected to a drive shaft which is in turn connected to the boat's power unit. The impeller turns through a restricted area having critical clearances and is supported by fine bearing surfaces, to cause the flow of water through a directional element that can be pivoted. The pivoted directional element receives water that has been pressurized and accelerated by the impeller and directs it in a particular direction for steering. It also provides variable thrust, depending upon the angle of attack of the water sprayed out thereby.

The critical nature of the tolerances and the overall operational characteristics of the impeller and directional element must be protected from foreign matter, or they will wear and in some cases, cease to function. Previously to this invention, there has not been any adequate means of covering the inlet opening to the impeller. The problem resided in part due to the fact that the problem could only be solved in an alkward manner by providing a frictionally engaging cover over the inlet grate.

In addition to the foregoing drawbacks to such covers, the implacement thereof when the boat is on the trailer, or in the water, becomes very difficult. As can be appreciated, many jet driven boats are launched from a trailer and a user must reach substantially under water to implace the cover forward of the transom of the hull.

This invention provides a superior cover that seals off the inlet from foreign matter and can be attached easily. The attachment is enhanced by overcenter latching hook that is linked by an eccentric to a handle. The handle after the cover has been implaced over the opening, is merely rotated through a portion of its axis which serves to move a linkage through a hooking engagement movement over the grillwork so that it moves upwardly, over the grillwork and downwardly in secured relationship to pull the cover tightly over the opening. In this manner, the cover is sealed in a strong mechanically linked manner with a linkage that operates a hook for engaging the grate in a facile manner to secure it tightly in sealed relationship to the grate.

SUMMARY OF THE INVENTION

In summation, this invention comprises an easily operated overcenter latching engagement means and cover combination for covering the opening of a jet drive boat.

More particularly, the invention incorporates a formed cover with a sealing strip therearound which engages the grillwork or grating of a jet drive boat. The engagement provides a seal so that foreign substances are eliminated from the system of the jet drive boat.

The cover is secured to the bottom grillwork of the opening of the jet drive boat by means of a hand operated linkage. The hand operated linkage incorporates a handle which causes an eccentric member to move rotationally through its axis. The eccentric member in the movement through the rotation of its axis serves to move a hooking member through an upward and downward movement with a degree of lateral engagement action to override a portion of the grate or grillwork of the opening of the jet drive boat.

The facile operation of the handle through its axis places the hook in an overcenter relationship to the grillwork or grate of the opening of the jet drive boat and secures it in tightened relationship during the movement of the handle through its axis. This enables an engagement and seal of the cover in tightened relationship around the periphery of the opening to avoid the introduction of foreign matter into the opening of the jet drive boat.

BRIEF DESCRIPTION OF THE DRAWINGS

The invention will be more clearly understood by reference to the description below taken in conjunction with the accompanying drawings wherein:

FIG. 1 shows a perspective projected view of the cover of this invention in its removed relationship from the opening of the jet drive boat;

FIG. 6 shows a sectioned view of the cover in the direction of lines 6—6 of FIG. 4;

FIG. 7 shows a detailed sectioned view identifying the handle and eccentric elements of the linkage in the direction of lines 7—7 of FIG. 4 when the hooking member is in its disengaged position;

FIG. 8 is the same showing of FIG. 7 except the handle has been operated to engage the grillwork of the opening of the jet drive of the boat;

FIG. 9 shows a detailed sectional view of the eccentric member of the invention in the direction of lines 9—9 of FIG. 4;

DESCRIPTION OF THE PREFERRED EMBODIMENTS

Figure 2:
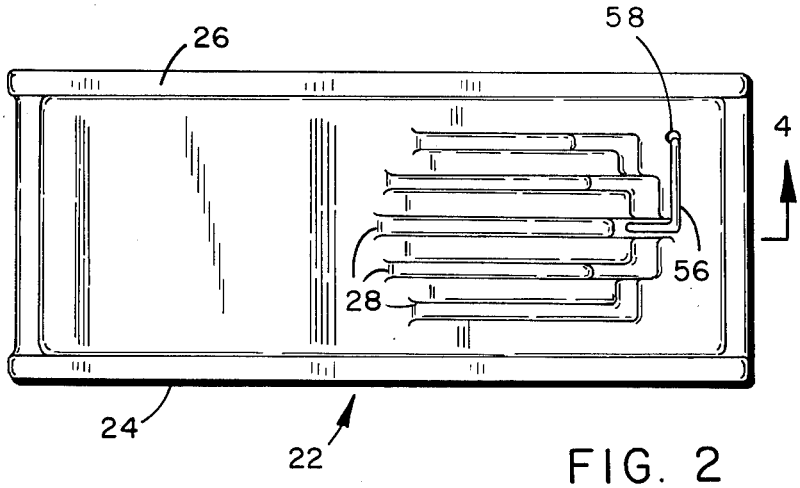
FIG. 2 shows a bottom plan view of the cover in the direction of lines 2—2 of FIG. 1.
Figure 3:
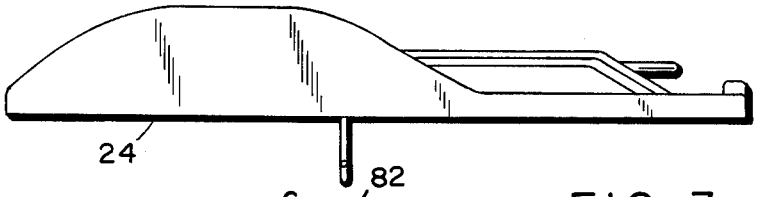
FIG. 3 shows a side elevation view of the invention.
Figure 4:
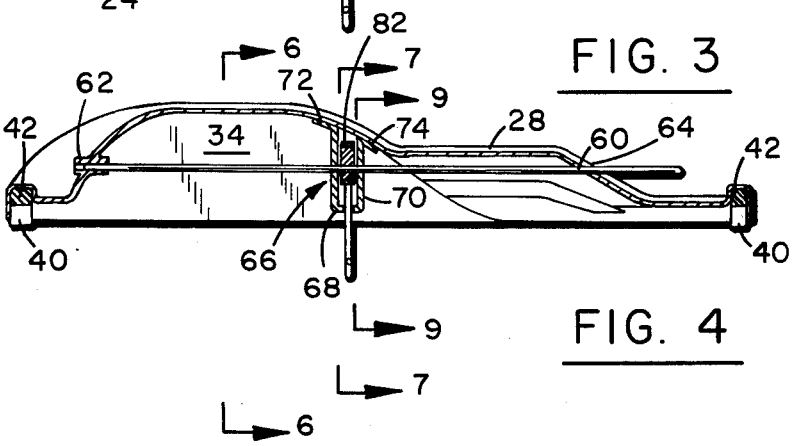
FIG. 4 shows a sectioned view of the cover of this invention in the direction of lines 4—4 of FIG. 2.
Figure 10:
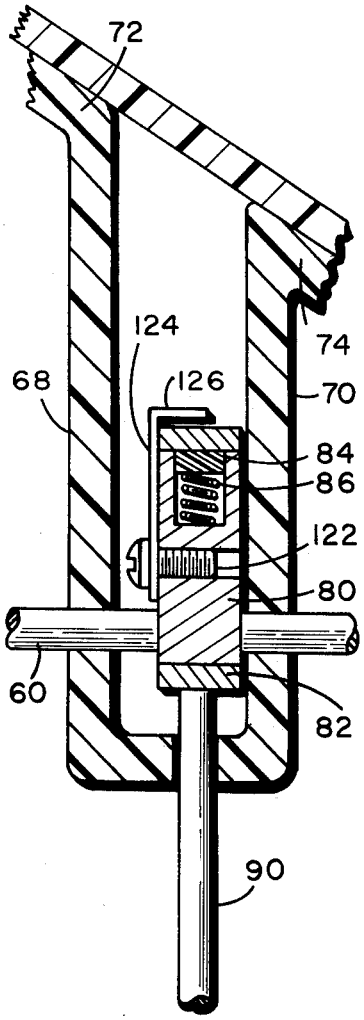
FIG. 10 shows a detailed sectional view through the cam member and operating elements of this invention in the direction of lines 10—10 of FIG. 8; and, FIG. 11 shows a sectional view of this invention with the operative elements in a stored position.
Figure 5:
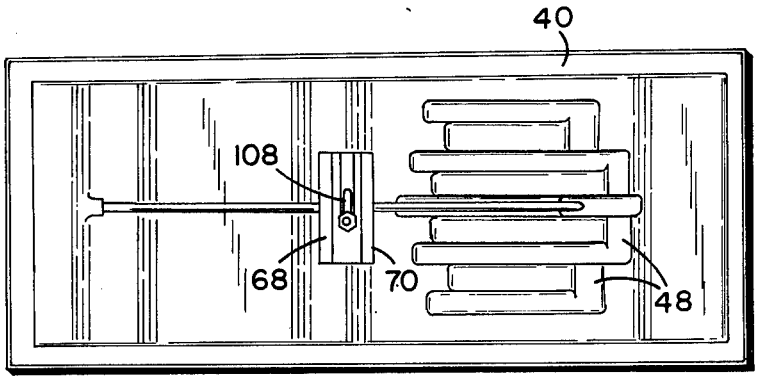
FIG. 5 shows a view looking into the interior of the cover of this invention.

Looking more particularly at FIG. 1, a boat hull 10 can be seen with an intake fixture, adapter, or grate 12 mounted therein. The fixture or intake adapter has a pair of main ribs or skegs 14 and 16 thereon and an opening generally shown at 18. The opening 18 is covered by a series of longitudinal grate or grill members 20.

The invention comprises a main cover 22 to be used in cooperation with the foregoing fixture or grate 22. The cover 22 comprises a pair of main recesses 24 and 26 that receive the ribs or skegs 14 and 16 therein. A series of minor ribs concavely forming longitudinal slots 28 have been shown which mate with the gridwork member ribs 20 over the opening 18.

As should be understood, the opening 18 leads into a pump unit or impeller that drives the boat 10 through the water. The impeller ejects a stream of water backwardly that has been received through the opening 18 by the gridwork 20.

As an aside, the cover 22 has two ports 30 which allow the drainage of water that is captured within the opening 18 after the cover 22 has been implaced thereover.

Looking more specifically at the remaining FIGURES in cooperation with the respective showings in FIG. 1, it is seen that the cover 22 has a major interior cavity 34 that slopes upwardly away from the minor ribs 28. The cavity 34 is such that it can receive the major ribs 14 and 16 in side channel areas 24 and 26 thereof. The side channel areas 24 and 26 define the boundary areas of the main cavity area 34.

A channel 40 circumscribes the periphery of the cover 22 including the side channel areas 24 and 26, in order to allow a closure over the major ribs or skegs 14 and 16. The periphery of the fixture or grate 12 generally comprises a raised peripheral wall or bead around the fixture 12. In other words, a raised wall or bead generally circumscribes the fixture or grillwork 12 all the way around the periphery thereof and must be received in something. As a consequence, the channel 40 performs the function of receiving and sealing the opening 18 by overlying the wall or bead circumscribing the fixture 12.

The channel 40 has a urethane foam 42 implaced therein around its periphery. The foam 42 provides a cushioned resilient sealant around the edge of the channel 40 so as to prevent the introduction of foreign material through the seal.

The interior of the cavity 34 flows into the smaller concavities formed by the minor ribs 28. These concavities have been shown as concavities 48 that define the general configuration of the grillwork or longitudinal grate members 20.

The foregoing cover 22 can be formed of any suitable materials. In the specific embodiments, as shown, it is formed as a plastic molded part. However, it should be understood that it can be blow molded, vacuum formed, injection molded, or formed in any other suitable manner of either a plastic or a sheet metal.

The general configuration as previously described relates to a cover to provide an overlayment or closure to a specific opening for a jet drive pump of a boat. However, the cover can be formed to match any particular fixture. As a consequence, the teachings herein should be understood to comprise any general conformation of cover for an intake for a jet boat opening leading to the impeller, and having the mechanical linkages or latches generally described hereinafter. In other words, any conformation of configuration of opening which is covered by the disclosure hereof in the general manner described is thought of as being within the scope and spirit of this invention.

Looking more particularly at the mechanical latching means of this invention, it can be seen that a handle member 56 is shown. The handle member 56 has a ball at the end 58 thereof for ease of manual articulation and to provide a rounded safe end thereof. The handle 56 is bent over at a ninety degree angle and is formed as a portion of a rod 60 which passes through the interior of the cover 22 and outwardly through a journal support 62. The journal support is formed as an opening having a cylindrical formation within the wall of the cover 22 that surrounds in part the major cavity 34. The rod 60 is supported at the other end by a through hole or opening 64 within the wall of the cover 22 near the end thereof.

Intermediately between the two ends of the rod 60 is a walled mid-supporting portion 66 comprising double walls 68 and 70. The double walls 68 and 70 respectively support the rod 60 intermediately through the end portions thereof. The walls 68 and 70 terminate respectively in flanges 72 and 74 which spread out and are adhered or molded to the inside portion of the base or wall of the cavity 34. The flanges 72 and 74 are only indicative of the type of support that can be utilized for the walls 68 and 70.

Looking more specifically at the operative latching mechanism hereof, it can be seen that the rod 60 is attached to a disc 80. The disc 80 is attached to the rod in any suitable manner. However, it should be understood that the disc in this embodiment is affixed to the rod in a manner whereby, as the rod 60 rotates through its axis, it also turns the disc 80. The disc 80 can be bored with a hole therethrough, having the rod 60 affixed to the disc for turning it. Also, the rod 60 can be separated into two portions and abutted to the disc 60 and welded to the surface thereof for rotating the disc 80 in its rotational axis.

The disc 80 has a slip ring 82 circumscribing the circumference thereof. The slip ring 82 is such that it is free to rotate against the outer surface of the disc 80.

The disc 80 and the slip ring 82 should not be free to rotate in a free and substantially frictionless movement. As a consequence, a frictional engagement is provided by an insert 84 biased by a spring 86 that moves the friction member 84 against the inner surface of the slip ring 82. This serves to provide friction between the outer surface of the disc 80 and the inner surface of the slip ring 82.

The frictional engagement allows for a constant frictional biasing force to prevent unwarranted movement of the device from one position to the other. It eliminates a degree of looseness at the respective interfacing surfaces of the disc 80 and the slip ring 82. However, it should be understood that any frictional engagement between the disc 80 and the slip ring 82 can be provided, such as a spring biased leaf member, a ball and spring detent, or any other suitable frictional engagement.

The handle 56 is such that it can operate the rotational movement of the disc 80 around an offset axis thereof. In other words, the movement of the disc 80 is through an offset axis that is not the central axis of the disc 80. This provides eccentric movement of the slip ring 82 to create the latching function of the invention.

Looking more particularly at the latching or engagement member of the invention, it can be seen that a hook 90 is shown having a terminal end 94 with a crooked portion 96 thereat. The crooked portion 96 serves to engage the grid members 20 of the gridwork so as to allow for a secure affixation of the cover 22 against the entire fixture 12 in a tight and secure manner. FIGS. 7 and 8 respectively show the disengaged and engaged positions of the hook member 90.

The hook member 90 is affixed by a weldment 100 to the slip ring 82. This affixation of the hook member 90 can be in any suitable manner and it is not necessary that it be affixed by a weldment, but can be tapped or implaced by threads or any other suitable means.

A stop is implaced within the wall member 66 in the form of a threaded bolt 104 and engagement backup member 106. The threaded bolt 104 can be threaded in and out of the backup member 106 which of course can be in the form of a nut in order to slide it back and forth in a slot 108 to allow for various stop positions of the member 90. This allows the placement of the member 90 to accommodate itself with respect to the position of the openings between the grate members 20 which it is to engage. In other words, the members 104 and 106 are placed depending upon the type and placement of the grate members 20 that are to be engaged by the terminal end 94 of the hooking member 90. Respective engagement or hooking effect is such that the member 90 must be offset or positioned in different areas and the bolt 104 and backup member 106 effectuate those positions.

The central axis of the disc 80 has a threaded opening 120 therein which receives a screw 122 that holds an L-shaped clip 124. The L-shaped clip has a portion thereof in the form of a leg 126 which overlies the outer surface of the slip ring 82. The L-shaped clip 124 serves as a stop and a positioning member for moving the hook or engaging member 90. In other words, in order to disengage the engagement member 90, the leg 126 of the L-shaped member 124 swings around in its affixed relationship to the disc 80 so as to move the hook member 90 with respect to the grate members 20 for withdrawal of the entire cover 22 from over the opening 18.

The latched position shown in FIG. 8 is when the latching member or hook 90 has been placed in an upright position and moved from the position of FIG. 7 to the position of FIG. 8 by means of an eccentric movement by the relationship of the disc 80 with the slip ring 82. This causes the member 90 to move eccentrically when it is being implaced on the grate 20 downwardly and laterally into tightened juxtaposition onto the grate for holding the entire cover 22 over the grate. In other words, during operation of the movement of the handle 56 from the position indicated in FIG. 7 to the position indicated in FIG. 8, the eccentric relationship of the disc 80 and the slip ring 82 cause the hook 90 to be implaced over the grate 20 and secured thereby, in an overcenter latched relationship.

It should be understood that any overcenter latching member operated by a handle which allows the cover 22 to be attached to the grate members 20 is contemplated by the scope and spirit of this invention. As a consequence, the following claims should be read broadly in light of the foregoing features so as to allow for the broadest scope coverage and spirit as contemplated by the teachings of this specification.

I claim:

1. A cover for an opening of a jet drive boat propulsion system for mounting on a boat hull wherein the opening is formed within a fixture implaced in the bottom of the boat hull and has a grating thereover said cover comprising:

a housing for substantially conforming to the fixture in a manner whereby it covers the opening; and an overcenter latching device connected to said housing and having an engagement hook for latching to the grating wherein said hook is operable from the outside of the housing by an eccentric linkage means which moves said engagement hook eccentrically from an unsecured into a secured relationship with a portion of the grating.

2. The cover as claimed in claim 1 further comprising:

a flange around the periphery of said housing for sealing it to said fixture.

3. The cover as claimed in claim 2 further comprising:

a channel defined by said flange with a resilient medium therein to engage the periphery of the opening of said fixture.

4. The cover as claimed in claim 1 wherein said eccentric linkage means comprises:

a slip ring to which said hook is attached said slip ring having an inner surface; and, a disc interfacing the inner surface of said slip ring adapted to be operated by a handle means for eccentric movement of said slip ring for engagement of said grate by said housing.

5. The cover as claimed in claim 4 wherein said handle means comprises:

an elongated handle for movement axially about its center and extending outwardly from said housing and which is affixed to said disc for movement of the disc in an eccentric manner with respect to said slip ring.

6. The cover as claimed in claim 5 further comprising:

a wall support for holding the disc and slip ring in relationship to each other within the housing; and, stop means attached to said wall support for changing the position of said hook.

7. The cover as claimed in claim 6 further comprising:

a member attached to said disc for orienting said hook with regard to its placement with respect to the grate.

8. The cover as claimed in claim 7 further comprising:

a means for applying friction between said slip ring and said disc.

9. The cover as claimed in claim 8 wherein said friction applying means comprises:

a radially movable member attached to said disc for engaging the inner surface of said slip ring; and, means for biasing said movable member outwardly from the disc against the inner surface of said slip ring.

10. The combination of the cover of claim 1 wherein said grating consists of an elongated grillwork within said fixture.

* * * * *